US005299917A

United States Patent [19]

Schultz

[11] Patent Number: 5,299,917

[45] Date of Patent: Apr. 5, 1994

[54] EVACUATION PUMP SYSTEM WITH CHECK VALVES FOR BOTH RIGID AND FLEXIBLE CONTAINERS

[75] Inventor: Glen R. Schultz, Yorkville, Ill.

[73] Assignee: Pioneering Concepts Incorporated, Yorkville, Ill.

[21] Appl. No.: 18,202

[22] Filed: Feb. 16, 1993

[51] Int. Cl.[5] ..... F04B 39/10; B65B 31/00

[52] U.S. Cl. ..... 417/238; 417/442; 417/553; 417/503; 53/510; 53/512; 53/88

[58] Field of Search ..... 417/442, 456, 458, 503, 417/545, 553, 238; 53/510, 512, 88, 103

[56] References Cited

U.S. PATENT DOCUMENTS

| | | | |
|---|---|---|---|
| 1,466,804 | 9/1923 | Orr | 417/503 |
| 3,220,351 | 11/1965 | Kling | 417/458 |
| 3,941,518 | 3/1976 | Eaton et al. | 417/442 |
| 4,583,925 | 4/1986 | Hawkins | 417/555.1 |
| 4,745,730 | 5/1988 | Bartle, Sr. | 53/512 |
| 4,975,028 | 12/1990 | Schultz | 417/442 |
| 5,121,590 | 6/1992 | Scanlan | 53/510 |

FOREIGN PATENT DOCUMENTS

| | | | |
|---|---|---|---|
| 611846 | 6/1979 | Czechoslovakia | 53/512 |
| 166478 | 8/1950 | Fed. Rep. of Germany | 53/103 |
| 620292 | 4/1927 | France | 53/103 |
| 307939 | 9/1932 | Italy | 53/103 |

*Primary Examiner*—Richard A. Bertsch
*Assistant Examiner*—Roland G. McAndrews, Jr.

[57] ABSTRACT

An improved evacuation pump system with dual inlet check valves uniquely designed to evacuate both lidded rigid containers and sealable flexible containers. A vacuum cup fixed to one end of a reciprocating piston pump attaches to the lid of rigid containers for their evacuation and a flexible probe connects to the pump for flexible container evacuation. To achieve this dual function two check valves mounted in the lower end of the pump are provided for the flexible container evacuation mode. One prevents discharge flow into the flexible probe and the other maintains suction in the cup to keep the pump attached to its supporting surface.

8 Claims, 3 Drawing Sheets

EVACUATION PUMP SYSTEM WITH CHECK VALVES FOR BOTH RIGID AND FLEXIBLE CONTAINERS

BACKGROUND OF THE INVENTION

This invention relates to a pump apparatus for evacuating containers. The invention is particularly adapted to evacuate air from food storage containers, such as jars and plastic bags.

The prior art is prolific in patents that disclose various types of pumps for evaluating air from food containers. The most pertinent patents to the present invention are believed to be the following:

Gill, U.S. Pat. No. 29,582
Winters, U.S. Pat. No. 638,383
Desmond, U.S. Pat. No. 882,874
Staunton, U.S. Pat. No. 1,601,705
Herzog, et al., U.S. Pat. No. 2,401,638
Crook, U.S. Pat. No. 2,648,474
Haley, U.S. Pat. No. 2,695,741
Reisinger, U.S. Pat. No. 3,312,256
Katell, U.S. Pat. No. 3,313,444
Ruberg, U.S. Pat. No. 4,278,114
Maruscak, U.S. Pat. No. 4,337,804
Scanlan, U.S. Pat. No. 4,478,025
von Bismarck, U.S. Pat. No. 4,575,990
Hawkins, U.S. Pat. No. 4,583,925
Bartle, Sr., U.S. Pat. No. 4,745,730

European Patent No. 0 117 247
German Patent No. 33 35 001
Swiss Patent No. 200,360

These patents disclose pumps for evacuating either rigid containers (jars) or deformable containers(plastic bags), but not both. Additionally, the arrangements most pertinent to this invention employ complex and difficult to apply check valves to the covers(or lids) of rigid containers to be evacuated.

The present invention is an improvement on my U.S. Pat. No. 4,975,028 and portions of the specification thereof have been included in this application.

The pump apparatus in my prior patent consists of three principal components; in particular, (1) a specially designed disposable/reusable, pressure-sensitive, adhesive-tape check valve that adheres to a container lid and covers a small air evacuating hole, (2) a reciprocating two-stroke piston pump that features an efficient piston check-valve and a vacuum cup which cooperate with plugable porting to provide for evacuation of both rigid and deformable containers, and (3) an accessory probe which is plugged into side plugable port of the pump to evacuate deformable containers such as plastic bags, while the bottom plugable port is plugged, thousands of times.

With this pump apparatus, a jar can be reused to store anything that will fit and which will keep better in a vacuum. The apparatus also pulls a vacuum on an ordinary plastic zipper-lock type bag and allows the zipper to be closed without losing the vacuum. The apparatus will also evacuate any leak proof bag that might be sealed with a commercial home-style hot-sealing machine.

A principal object of this invention is to provide relatively simple, inexpensive and effective apparatus for evacuating both rigid and deformable containers, such as jars with lids and also plastic bags.

While my prior patented design works well and has achieved considerable commercial success, I have devised an improved pumping system that eliminates the need for a check valve in the flexible probe assembly and the requirement for a removable plug to maintain cup suction. The prior in-line check valve has many parts and is difficult to manufacture and expensive to purchase preassembled. The removable plug works well in maintaining suction in the cup but it is easily lost and its use requires careful operator instruction.

Therefore, it would be desirable, and it is the principal object of the present invention to not only eliminate the need for the in-line check valve in the flexible probe assembly and the removable plug for the vacuum cup, but also to provide an evacuation apparatus that is simpler to use and requires less operator instruction.

SUMMARY OF THE PRESENT INVENTION

In accordance with the present invention an evacuating pumping system is provided that operates in two distinct modes to evacuate flexible containers and rigid containers, and the switch between modes is effected by the insertion or removal of a tethered plug from a single part.

Toward these ends the pump is provided with two inlet ports, one for the flexible evacuation probe and one for the vacuum cup interior. The probe port is selectively closed by a plug that is tethered to the pump to prevent its loss. The pump is provided with a main central inlet passage that connects to both of these inlet ports, the probe port being connected thereto by a transverse passage that intersects the inlet passage, and the suction cup port is a coaxial extension of the inlet passage.

A first check valve is defined by a ball valve and seat in the main inlet passage between the transverse bore and the pumping chamber and operates to block flow to the flexible probe during the discharge stroke of the piston in the flexible bag evacuation mode. A second check valve is defined by another ball and valve seat in the inlet passage but these are positioned between the transverse passage and the vacuum cup. This check valve maintains suction in the cup during the flexible bag evacuation mode which would otherwise be lost in the piston discharge stroke.

Neither of these check valves has any function in the rigid container evacuation mode because they both float in that mode. In that mode the lid mounted valve prevents discharge flow into the container and the removable plug, then in place, prevents flow into the flexible probe port. Since both valves open toward the pumping chamber, neither interfere with rigid container evacuation during the suction stroke.

These two check valves considerably simplify the operation of the pump. When switching from the rigid container mode to the flexible container mode, the plug is removed and the flexible probe inserted in the probe port. The plug cannot be lost because it is tethered to the pump and it is unnecessary to plug the suction cup part as before. Switching back to the rigid container mode is simpler because the user can easily understand without instruction the flexible probe port needs to be plugged by the plug tethered next to it, and there is of course no need to tell the user to then remove the vacuum cup plug as before because it has been eliminated an its function is achieved automatically by one of the check valves.

Other objects and advantages of the present invention will appear more clearly from the following detailed description.

BRIEF DESCRIPTION OF THE DRAWINGS

In order that all of the structural features for attaining the objects of this invention may be understood, reference is made to the accompanying drawings wherein.

DETAILED DESCRIPTION OF THE PREFERRED EMBODIMENT

Figure 4:
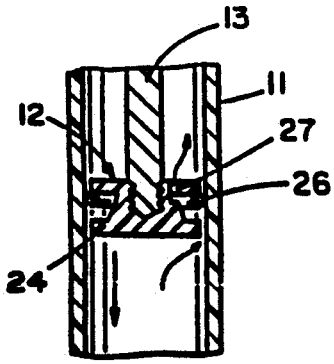
FIG. 4 PRIOR ART
FIG. 4 is a fragmentary section view of the pump piston-valve during a piston down-stroke.
Figure 5:
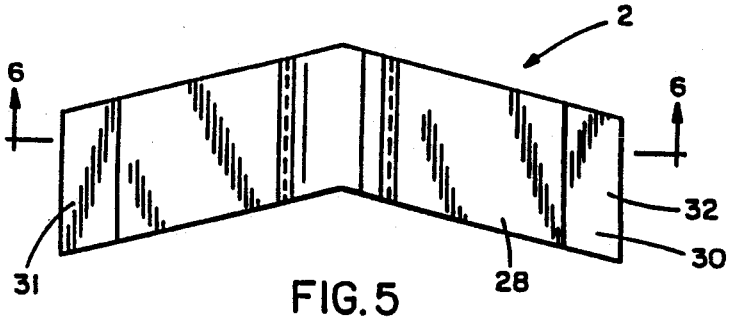
FIG. 5 PRIOR ART
FIG. 5 is a plan view of the adhesive-tape check valve with its peel-off, throw-away backing attached to protect the adhesive layer and the elastomer pad of the valve.
Figure 6:
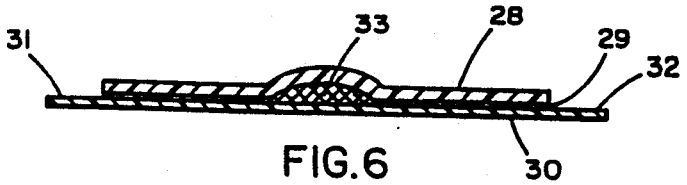
FIG. 6 PRIOR ART
FIG. 6 is a section view taken along line 6—6 of FIG. 5 which shows the several layers of the adhesive-tape check valve and the encapsulated elastomer pad.

Referring to the drawings, the principal components of my patented design (FIGS. 1 to 9) comprise piston pump 1 and an adhesive tape check valve 2 (FIGS. 5 and 6). This is particularly adapted to evacuate rigid containers, such as jar 3, by applying check valve 2 over a small hole punched in lid 4 of jar 3.

Pump 1 in association with probe 5 (FIG. 7) is also used to evacuate a non-rigid container, such as plastic bag 6. An in-line check valve 7 (FIGS. 7 and 8) having a rigid housing is inserted in the air line of probe 5.

In the first use, plug 8 is inserted in side port 9 (FIG. 1) to block a side inlet; however, in the second use plug 8 is removed from the side port 9, and check valve 7 end of probe 5 is inserted in side port 9. Plug 8 is inserted in the throat of vacuum cup 10 (FIG. 9) to block any possible passage of air through the vacuum cup and to convert the vacuum cup into a vacuum cup so that the pump assembly can be affixed to a table.

Piston pump 1 is used in both modes without any change in structure. In particular, the pump consists of a 1¾ inch diameter vacuum cup 10 fabricated from a flexible soft plastic and is fixed to one end of plastic tube 11. Tube 11 defines a pump cylinder, the bore of which houses a uniquely designed O-ring piston-check-valve 12. The piston-check-valve is connected to one end of a spring-loaded, metal or plastic rod 13; and a manually actuatable push-pull knob 14 is fixed to the other rod end to reciprocate the piston-check-valve to effect air evacuation. Rod 13 need not be spring loaded when evacuating a jar.

Pump 1 is approximately 14 inches long when assembled for use. Tube 11 is approximately 6 inches long and it has a 7/8 outside diameter. For shipment, cleaning and storage, the pump may be broken down to about 9 inches with one simple jerking motion which separates top end cap 15 from cylinder 11. Alternately, the pump assembly may be conveniently stored in a broom clip on a wall or cabinet door.

Figure 1:
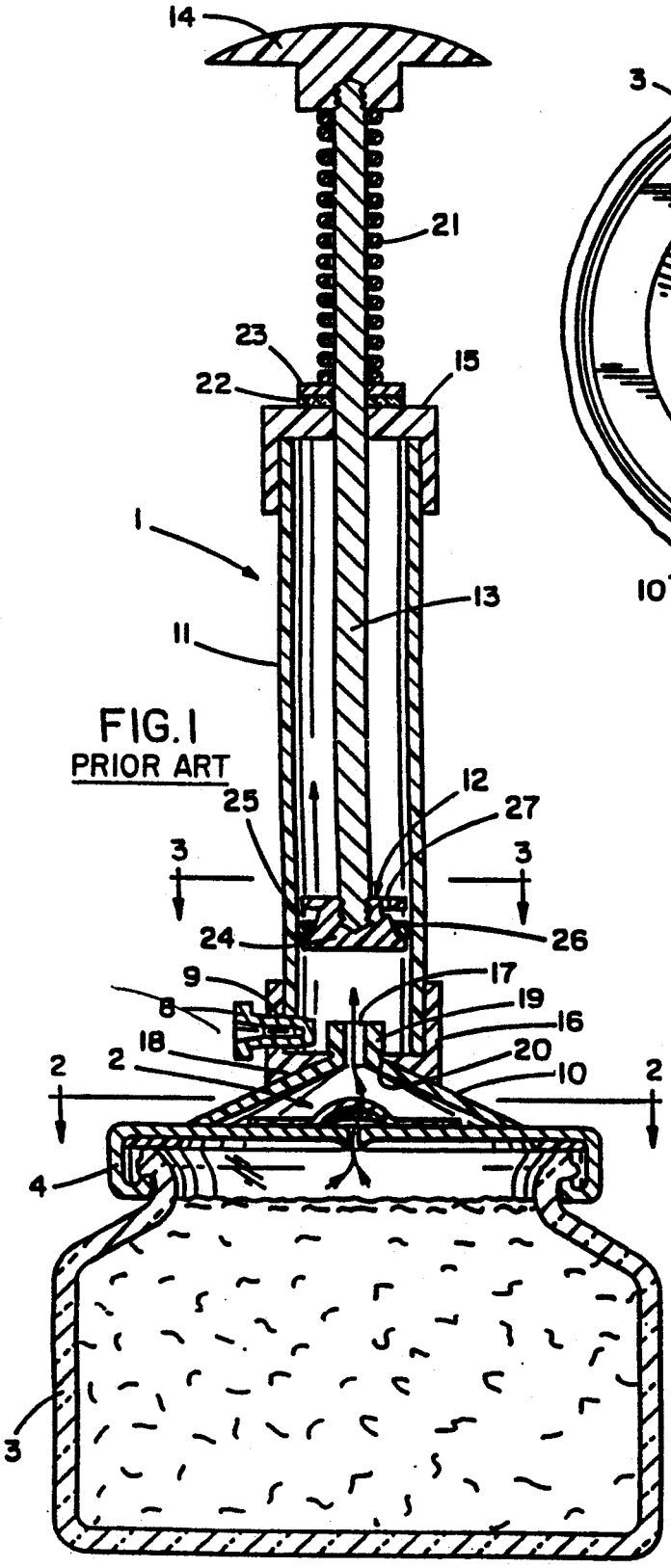
FIG. 1 PRIOR ART
FIG. 1 is an elevation view in section of the pump apparatus shown in my prior patent during a piston up-stroke applied to the lid of a container(food jar) to evacuate air from the inner container cavity which holds the material(food) to be preserved.
Figure 2:
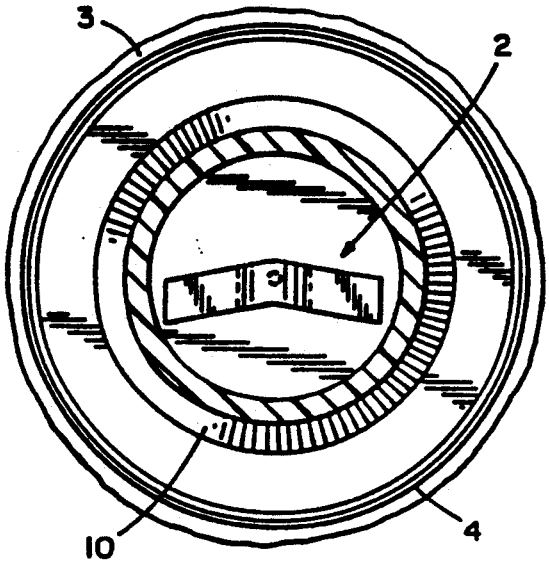
FIG. 2 PRIOR ART
FIG. 2 is a section view taken along line 2—2 of FIG. 1 which shows a plan view of a specially designed disposable/reusable, pressure-sensitive, adhesive-tape check valve applied to the container of FIG. 1.
Figure 3:
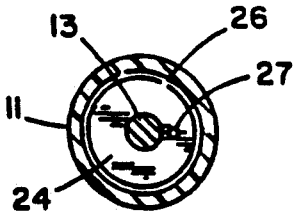
FIG. 3 PRIOR ART
FIG. 3 is a section view taken along line 3—3 of FIG. 1 which shows the vent hole for the pump piston-valve.

Bottom end cap 16 couples vacuum cup 10 to the lower end of tube 11. Side port 9 extends through both tube 11 and bottom end cap 16. Plug 8 is inserted in port 9 when air is to be evacuated from jar 3 through the central passage formed by throat 17 of vacuum cup 10, as is shown in FIG. 1. Tube 11 and end caps 15 and 16 are formed of a rigid shatter resistant such as CPVC plastic. The tube and end caps could also be fabricated of glass or metal.

An inwardly projecting annular lip 18, which defines a centrally located hole, is integrally formed on the lower portion of bottom end cap 16. Neck 19 of vacuum cup 10 is formed with an annular recess 20 which engages lip 18 when neck 19 is press fit through the hole formed by lip 18. The special shape of the bottom end cap defines a small chamber into which adhesive-tape check valve 2 can move up and down. Without this chamber vacuum cup 10 would be sucked flat by the pumping action, thereby ultimately defeating the operation of adhesive-tape check valve 2.

Top end cap 15 is formed with a central hole to enable spring-loaded rod 13 to reciprocate within the cylinder cavity defined by tube 11. Knob 14 is threaded, glued, or snap fit onto the upper end of the rod. Helical return spring 21 envelopes rod 13 between knob 14 and top end cap 15. The return spring is sized for easy operation and to supply sufficient force to provide adequate vacuum with a reasonable number of strokes, and to withstand many operations.

Optionally, spring 21 and rod 13 are continuously lubricated by an oil saturated felt washer 22 sandwiched between a flat steel washer 23 and top end cap 15. Return spring 21 keeps washer 22 in permanent compression so as to fit tightly around rod 13.

Body 24 of piston-check valve 12 is fabricated from a machined or molded plastic, metal, or ceramic. The outer periphery of piston body 24 is formed with an annular groove 25. This groove width is oversized relative to the cross-section of its contained O-ring 26, and the groove diameter is tapered and small at one end relative to the inside diameter of its contained O-ring, in order to provide proper pumping action which requires movement of the O-ring within the groove. A small piston vent hole 27 (FIG. 3) or notch provides an air passage from groove 25 through the upper portion of body 24.

Body 24 is sized diameter-wise so as to have a loose fit relative to the inner cylinder wall of tube 11. Air flows between body 24 and tube 11 unless this passage is blocked by O-ring 26.

Piston-check-valve 12 is open during the down-stroke (FIG. 4). In particular, during the piston down-stroke, O-ring 26 is forced upwardly against the top of oversized groove 25 by friction engagement with the cylinder wall. Accordingly, air flows around the periphery of the lower portion of piston body 24 into groove 25 below O-ring 26, and ultimately through piston vent hole 27 into the upper cylinder cavity.

Piston-check-valve 12 is closed during the upstroke (FIG. 1). In particular, during the piston up-stroke, O-ring 26 is forced downwardly against the bottom of oversized groove 25 by friction engagement with the cylinder wall. This action closes off the air passage otherwise appearing between the loose fitting piston body 24 and the adjacent cylinder wall. During the piston up-stroke, air confined in the cylinder cavity located above body 24 is forced out of pump 1 by a venting passage formed between rod 13 and top end cap 15.

During the piston up-stroke, adhesive-tape check valve 2 is open, as is shown in FIG. 1, thereby evacuating jar 3 of air. Conversely, during the piston down stroke, check valve 2 is closed.

Adhesive-tape check valve 2 (FIGS. 5 and 6) may be rectangular or chevron shaped or various other shapes in the preferred embodiment shown in the drawings. Either configuration facilitates reciprocating action which is necessary for a reliable check-valve action. The point of the chevron shaped valve may be preferred by some for easy removal of the valve or release of the vacuum.

Adhesive-tape check valve 2 is formed with a tape layer 28 which is coated with an adhesive layer 29. The adhesive-tape is supported on a throw-away, peel-off backing 30 whose ends 31 and 32 extend beyond layers 28 and 29.

An elastomer pad 33 which serves as a valve seat is captured in the central portion of tape layer 28 between adhesive layer 29 and backing 30. A preferred sealing material is a low durometer (about 30, Shore A) FDA elastomer pad of approximately $0.31 \times 0.31 \times 0.020$ inch which is bonded to the adhesive layer of the tape. The tape and sealing material that make up valve 2 can be reused many times.

The actual construction of valve 2 is accomplished by running a roll of vinyl adhesive-tape partially around a roller having a groove. The non-sticky side is in contact with the roller. The tape is manipulated so it conforms to the groove in the roller. Another roller in close proximity to the first has a roll of backing material partially wrapped around it. The backing is about 15 inches wide and the vinyl tape is 1.0 inches wide. The two tapes are roll pressed together. The void created by the groove in the first roller is filled with an FDA(food grade) uncured silicone rubber that is injected into the void just at the pinch line of the two rolls. After the silicone rubber cures, the valve are die-cut through the vinyl tape and silicone rubber but not through the backing. The valves are then distributed in lengths containing 25 to 50 valves per length.

In preparation for evacuating resealable jar 3, a small hole is punched in lid 4 near the center of the lid. Check valve 2 is placed (with peel-off backing 30 removed) with elastomer sealing pad 33 covering the small hole. During operation, vacuum cup 10 is placed on lid 4 over valve 2 (FIG. 1). As knob 14, rod 13, and piston-check-valve 12 are pushed down, piston-check-valve 12 is opened and adhesive-tape check valve 2 is closed. As spring 21 returns piston-check-valve 12 and rod 13 to its extended position, piston-check-valve 12 is closed and adhesive-tape check valve 2 is opened and air is drawn from jar 3 by the vacuum created by piston pump 1. The knob may also be pulled up manually if the spring is not used. The spring tension and piston diameter are designed to cause a vacuum, in the range of 25 to 27 inches of mercury, to be attainable.

Repeated reciprocations are made until jar 3 is adequately evacuated, which is noted by only a partial return of the knob 14 and rod 13 assembly to its fully extended position, or by the feel of a tightly adhered vacuum cup to the jar lid. This feeling of tightness can be compared when pump 1 is sucked tight to that of a smooth flat surface with no hole or other leaks. The number of reciprocations required for adequate evacuation varies with the volume of air in the jar. Maximum vacuum may be reached with as few as two reciprocations.

After jar 3 has been adequately evacuated, pump 1 is removed with adhesive-tape check-valve 2 remaining in place. When one desires to open jar 3, all that is necessary to release the vacuum, is simply to lift the sealing pad portion of valve 2 only far enough to uncover a portion of the hole in lid 4. After the hissing noise stops, the vacuum has been released and the jar may be more easily opened.

Contrary to the belief of some, nearly all of the vacuum sealed "throw-away" jars on the market today may be permanently resealed. Furthermore, by using pump 1 of this invention, the same jar, lid, and adhesive-tape check-valve 2 may be resealed many times. And, since adhesive-tape check-valve 2 is itself reusable, it may be transferred to another jar lid.

Additionally, using pump 1 of this invention, allows any store bought sealed jar to be easily opened, even by people with small and/or arthritic hands. Punching the hole in the jar lid, releases the vacuum that initially caused the jar to open with difficulty. After releasing the vacuum the hole may be covered with the adhesive-tape check valve in preparation for sealing.

Figure 8:
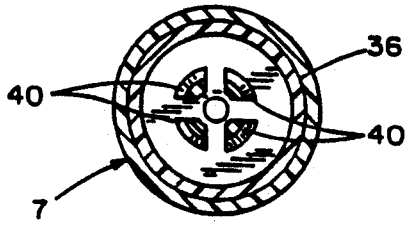
FIG. 8 PRIOR ART
FIG. 8 is a section view taken along line 8—8 of FIG. 7 which shows the internal construction of the check valve used in the probe of FIG. 7.
Figure 7:
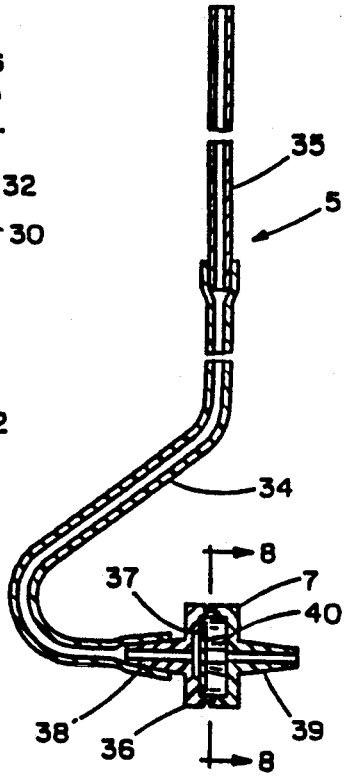
FIG. 7 PRIOR ART
FIG. 7 is an elevation view in section of an optional probe specially designed to evacuate plastic bags.
Figure 9:
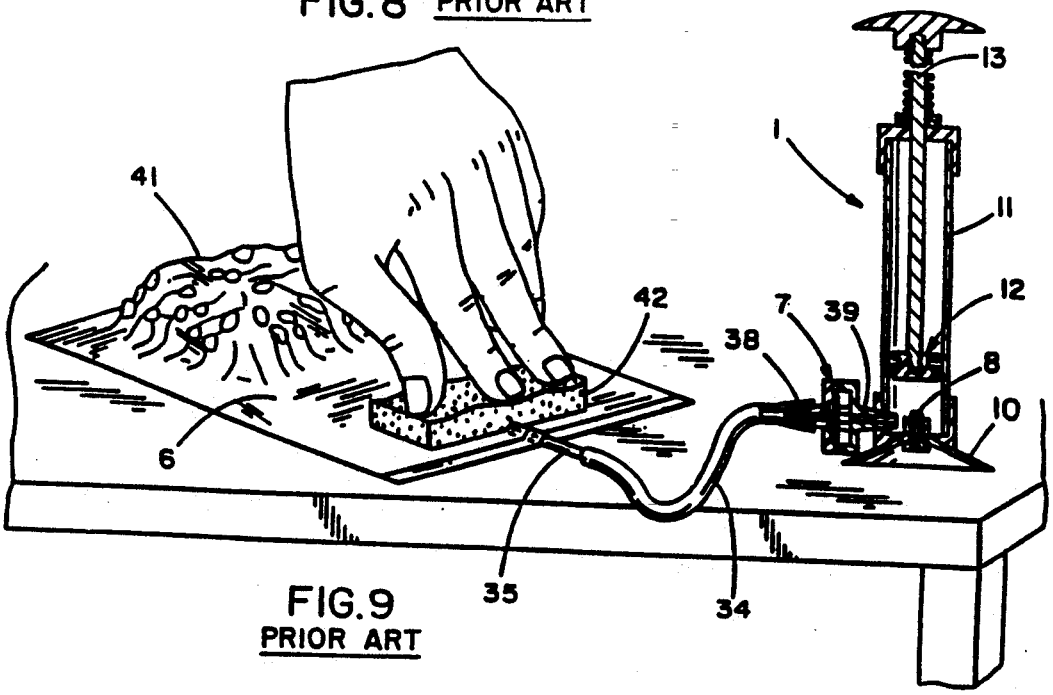
FIG. 9 PRIOR ART
FIG. 9 is a view in-part perspective and in-part in section showing the application of the pump with the probe of FIGS. 7 and 8 to a plastic bag containing material to be preserved.
Figure 10:
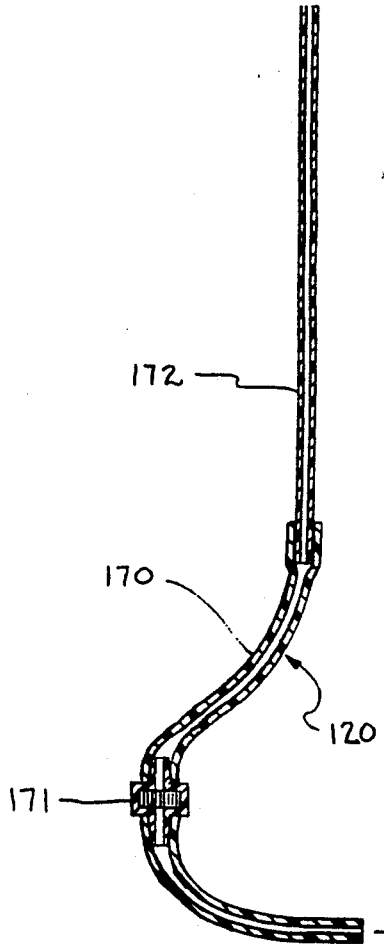
FIGS. 10 and 11 are longitudinal sections of the flexible evacuation probe assembly and pump apparatus according to the present invention.

The second mode shown in FIGS. 7, 8 and 9 employs an accessory kit which forms probe 5. Probe 5 is employed to evacuate non-rigid containers, such as plastic bags (FIG. 9). Probe 5 (FIG. 7) comprises a central section of an FDA approved flexible plastic tubing 34, a straight length of FDA approved rigid plastic tubing 35 inserted into the first end of tubing 34, and an in-line check valve 7 inserted into the other end of plastic tubing 34.

In-line check valve 7 is formed with a plastic housing body 36 that defines an internal cavity that contains a flexible valve seat disc 37 formed from FDA approved material. The periphery of the disc flexes to open and close the valve. Access to this internal cavity is obtained through apertured inlet nipple 38 and through apertured outlet nipple 39. Stop 40 limits the movement of valve seat disc 37 within housing body 36.

When probe 5 is used, the free end of rigid tubing 35 is inserted into the open end of sack 6(FIG. 9). A foam block 42 is preferably manually employed to hold tubing 35 in place and to keep the sack sealed around tube 35 during evacuation.

Plug 8 is removed from side port 9(the position shown in FIG. 1), and reinserted into central throat 17 of vacuum cup 10 (the position shown in FIG. 9). Outlet nipple 39 is inserted into port 9, and manual pumping is started as described with respect to the first embodiment of FIG. 1. The periphery of valve seat disc 37 flexes within the cavity of housing body 36. During the down-stroke, disc 37 closes inlet nipple 38; and during the up-stroke, disc 37 flexes against stop 40 thereby opening the check valve to permit air evacuation as previously described with respect to jar 3. When bag 6 has been adequately evacuated, probe 5 is removed from the bag, and the bag clamped closed by conventional means. The seal of the bag may be enhanced by coating the inner walls at the sealing area with vegetable oil, butter, or margarine.

The above description of FIGS. 1 to 9, as well as the FIGS. 1 to 9 themselves, are essentially incorporated from my U.S. Pat. No. 4,975,028 and are contained herein for the purpose of explaining the background of the present invention as well as the general dual mode operation of the present pump assembly, which is the same for the following embodiment disclosed in FIGS. 10 to 13 as in my prior patent, this following embodiment being essentially an improvement on my prior design.

Figure 11:
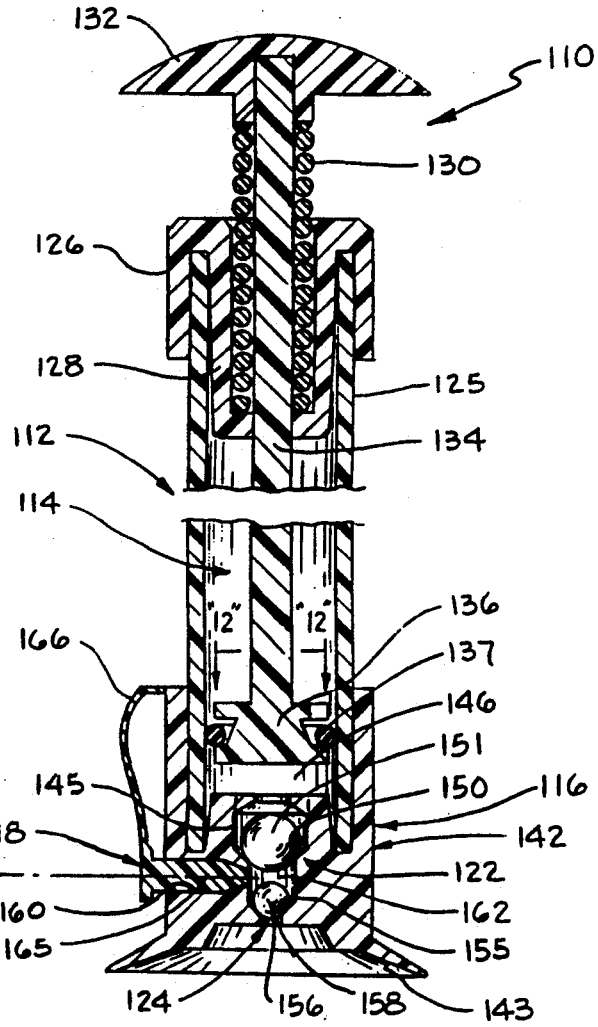
Figure 12:
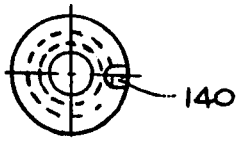
FIG. 12 is a fragmentary cross-section taken generally along line 12—12 of FIG. 11 showing the check valve piston in the pump.
Figure 14:
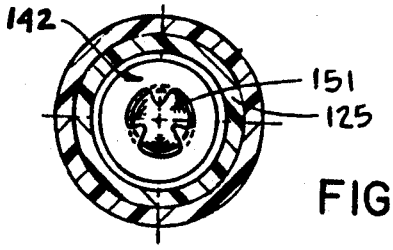
FIG. 14 is a cross-section taken generally along line 14—14 of FIG. 13.
Figure 13:
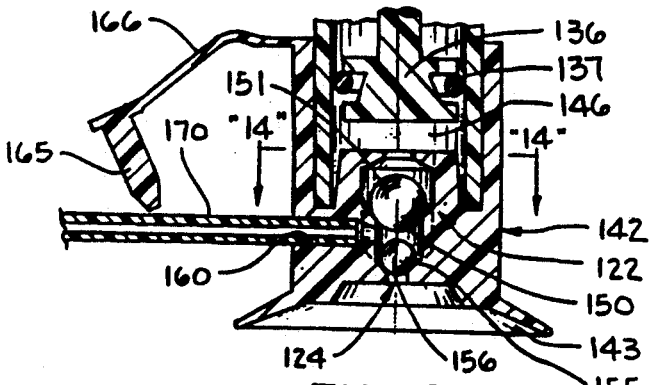
FIG. 13 is a fragmentary longitudinal section similar to FIG. 11 with the flexible evacuation probe assembly inserted into the pump apparatus.

With that background and as illustrated in FIGS. 10 to 14, an improved pump assembly 110 is illustrated consisting generally of a cylinder assembly 112 with a piston and rod assembly 114 slidable therein, an end cap and vacuum cup assembly 116, a tethered plug 118 useable in the rigid container evacuation mode, a flexible probe assembly 120 insertable into the end cap and vacuum cup assembly 116 as shown in FIG. 13 for the flexible container evacuation mode, a first upper check valve assembly 122 for blocking flow through evacuation probe assembly 120, and a second check valve assembly 124 for maintaining suction in the vacuum cup while attached to a supporting surface. Both check valves 122 and 124 operate usably only in the flexible container evacuation mode illustrated in FIG. 13.

The cylinder assembly 112 is seen to include a tubular cylinder 125 enclosed at its upper end by a one-piece molded upper end cap 126 that has a flanged tubular central portion 128 extending into tube 125 and forming a seat for a coil compression spring 130 that partly recesses the spring into the tube 125 to provide a more compact arrangement than in my prior patented design.

The upper end of the spring 130 engages and biases upwardly a spheroidal knob 132 connected to the upper end of rod 134 forming part of the piston and rod assembly 114.

The piston and rod assembly 114 is also constructed of a rigid plastic material and has an integral piston 136 on its lower end having an O-ring 137 mounted in an enlarged recess therein that cooperates with passage 140 shown more clearly in FIG. 12 to form a piston check valve that operates in an identical fashion to the piston check valve 12 described above in connection with the FIGS. 1 to 9 embodiment.

The end cap and vacuum cup assembly 116 includes a one-piece molding 142 constructed of an elastomeric material substantially softer than the other parts of the pump assembly 110 that is preferably of a material in the Shore A durometer range of 30 to 50 to not only provide the necessary flexibility for vacuum cup portion 143 but also to improve the sealing characteristics of the check valves 122 and 124, as well as the seating of plug 118, all as a result of the higher resiliency of the molding 142.

The molding 142 has a stepped inlet passage 145 communicating with pumping chamber 146 that defines a seat 150 for check valve ball 151 associated with check valve 122, and seat 155 associated with ball 156 in check valve assembly 124. Passage 145 has an opening 158 to the interior of the cup portion 143 and a transverse bore 160, tapered at its inner end, communicates the main inlet passage 145 in the area 162 between seats 150 and 155 to the exterior surface of the molding 142.

Bore 160 selectively receives a plug 165 tethered by an integral strap 166 to the top of the molding 142 or to a separate molded ring-strap-plug assembly which ring fits frictionally on cylinder tube 112 at top of molding 142.

The probe assembly 120 includes a flexible tube 170 having an in-line filter 171 therein, connected to a rigid tube extension 172 adapted to be inserted into flexible containers in the same manner as described above with respect to FIG. 9.

To operate the evacuation pump apparatus 110 in the flexible container mode, it is only necessary to remove plug 165 and insert the flexible probe into bore 160 as shown in FIG. 13. Note that the plug 165 remains with the assembly because it is tethered to molding 142. During the downward stroke of piston 136, ball 156 seats securely against seat 150 preventing air flow from pumping chamber 146 into flexible evacuation probe tube 170 which of course is important to prevent the inflation of the flexible container that is being evacuated.

During the upward stroke of piston 136, ball 151 unseats from seat 150 permitting air flow from the flexible container through the evacuation probe assembly 120 into the pumping chamber 146 producing the desired evacuation of the container.

During both the upward and downward strokes of the piston 136, the ball valve 156 associated with check valve 124 remains seated due to the vacuum inside the vacuum cup 143 bearing in mind that during the flexible container evacuation mode the vacuum cup 143 is attached to a suitable smooth horizontal supporting surface. More specifically, the area of the seat 155 is sized so that the pressure drop within the pumping chamber 146 during the flexible container evacuation mode is insufficient to unseat ball 156. However, even if ball 156 unseated as the piston moved upwardly, it would have no effect on the attachment of the vacuum cup 143 to the horizontal surface because it would only lower pressure within the vacuum cup and as soon as the piston 136 begins its downward stroke, ball valve 156 Will immediately reseat preventing any increase in pressure within the vacuum cup portion 143. Thus, the sole function of the check valve 124 is to maintain suction within the vacuum cup portion 143 during the flexible container evacuation mode so that the pump apparatus 110 remains attached to its support.

The return to the rigid container evacuation mode is easily achieved by simply withdrawing flexible probe tube 170 and re-inserting plug 165 back to the position shown in FIG. 11, and in this position the pump apparatus can be placed over the rigid container lid mounted check valve without further manipulation of the pump. During rigid container evacuation the check valves 122 and 124 have no function and simply open and close without any specific result because the adhesive check valve on the container lid prevents flow from the pump into the rigid container.

It can be seen with the pump apparatus 110 the operation of the pump is considerably simpler and specific instructions about the placement of the plugs required in my prior patented design are unnecessary, which is particularly helpful because users often-times discard operating instructions. Secondly, the elimination of the complex check valve in my prior flexible evacuation probe is a considerable cost saving, and the simple ball valves 122 and 124 that are formed for the most part integrally with the end cap and vacuum cup molding 142 considerably simplify the assembly of the present pump 110 as well as requiring fewer parts.

I claim:

1. An evacuation system for both lidded rigid containers and sealable flexible containers, comprising: a reciprocating piston pump having a reciprocating piston in a pumping chamber movable in a suction stroke and a discharge stroke, said pump including a check valve that closes during the suction stroke of the piston and opens during the return stroke, said pump having an actuator for the piston at one end and a sealable lid engaging cup at the other end, said pump having a rigid container evacuation mode and a flexible container evacuation mode, a first inlet port communicating with the interior of the cup, a second inlet port adapted to receive a flexible tube for evacuating flexible containers, means for selectively blocking the second inlet port in the rigid container evacuation mode, an inlet passage communicating with the pumping chamber and the first and second inlet ports, and a second check valve separate from the piston between the inlet passage and the first inlet port responsive to a vacuum within the cup for maintaining suction in the interior of the cup in the flexible container evacuation mode with the second inlet port unblocked, said second check valve being responsive to pressure in the inlet passage to open the first inlet port during the suction stroke of the piston in the rigid container evacuation mode.

2. An evacuation system for both lidded rigid containers and sealable flexible containers as defined in claim 1, and a third check valve completely within the pump between the inlet passage and the second inlet port that prevents flow through the second inlet port during the discharge stroke of the piston in the flexible container evacuation mode.

3. An evacuation system for both lidded rigid containers and sealable flexible containers, comprising: a reciprocating piston pump having a reciprocating piston in a pumping chamber movable in a suction stroke and a discharge stroke, said pump including a check valve that closes during the suction stroke of the piston and opens during the return stroke, said pump having an actuator for the piston at one end and a sealable lid engaging cup at the other end, said pump having a rigid container evacuation mode and a flexible container evacuation mode, a first inlet port communicating with the interior of the cup, a second inlet port adapted to receive a flexible tube for evacuating flexible containers, means for selectively blocking the second inlet port in the rigid container evacuation mode, an inlet passage communicating with the pumping chamber and the first and second inlet ports, and a second check valve between the inlet passage and the first inlet port for maintaining suction in the interior of the cup in the flexible container evacuation mode with the second inlet port unblocked, and a third check valve completely within the pump between the inlet passage and the second inlet port that prevents flow through the second inlet port during the discharge stroke of the piston in the flexible container evacuation mode, said inlet passage being a stepped axial bore extending from one end of the pumping chamber, a transverse passage in the pump connecting the second inlet port and the inlet passage, said third check valve including an integral valve seat in the inlet passage between the transverse passage and the pumping chamber and a ball valve member engageable with the seat positioned on the side of the seat closest the pumping chamber, said second check valve including an integral seat in the inlet passage between the transverse passage and the first inlet port and a ball valve member engageable with the second check valve seat positioned on the side of the seat closest the pumping chamber.

4. An evacuation system for both lidded rigid containers and sealable flexible containers, comprising: a reciprocating piston pump having a reciprocating piston in a pumping chamber movable in a suction stroke and a discharge stroke, said pump including a check valve that closes during the suction stroke of the piston and opens during the return stroke, said pump having an actuator for the piston at one end and a sealable lid engaging vacuum cup at the other end, said pump having a rigid container evacuation mode and a flexible container evacuation mode, a first inlet port communicating with the interior of the cup, a second inlet port adapted to receive a flexible tube for evacuating flexible containers, means for selectively blocking the second inlet port in the rigid container evacuation mode, an inlet passage communicating with the pumping chamber and the first and second inlet ports, and a second check valve completely within the pump between the inlet passage and the second inlet port that prevents flow through the second inlet port during the discharge stroke of the piston in the flexible container evacuation mode.

5. An evacuation system for both lidded rigid containers and sealable flexible containers, comprising: a reciprocating piston pump having a reciprocating piston in a pumping chamber movable in a suction stroke and a discharge stroke, said pump including a check valve that closes during the suction stroke of the piston and opens during the return stroke, said pump having an actuator for he piston at one end and a sealable lid engaging vacuum cup at the other end, said pump having a rigid container evacuation mode and a flexible container evacuation mode, a first inlet port communicating with the interior of the cup, a second inlet port adapted to receive a flexible tube for evacuating flexible containers, means for selectively blocking the second inlet port in the rigid container evacuation mode, an inlet passage communicating with the pumping chamber and the first and second inlet ports, and a second check valve between the inlet passage and the second inlet port that prevents flow through the second inlet port during the discharge stroke of the piston in the flexible container evacuation mode, and including a third check valve between the inlet passage and the first inlet port for maintaining suction in the interior of the cup in the flexible container evacuation ode with the second inlet port unblocked.

6. An evacuation system for both lidded rigid containers and sealable flexible containers as defined in claim 5, wherein the inlet passage is a stepped axial bore extending from one end of the pumping chamber, a transverse passage in the pump connecting the second inlet port and the inlet passage, said first check valve including an integral valve seat in the inlet passage between the transverse passage and the pumping chamber and a ball valve member engageable with the seat positioned on the side of the seat closest the pumping chamber, said second check valve including an integral seat in the inlet passage between the transverse passage and the first inlet port and a second ball valve member engageable with the second check valve seat positioned on the side of the seat closest the pumping chamber.

7. An evacuation system for both lidded rigid containers and sealable flexible containers as defined in claims 1 or 4, including a one-piece elastomeric suction cup and end cap in the pump, said inlet passage being formed integrally and axially in the one-piece suction cup and end cap, and a transverse bore in the suction cup and end cap connecting the second inlet port and the inlet passage.

8. An evacuation system for both lidded rigid containers and sealable flexible containers, comprising: a reciprocating piston pump having a reciprocating piston in the pumping chamber movable in a suction stroke and a discharge stroke, said pump including a check valve that closes during the suction stroke of the piston and opens during the return stroke, said pump having an actuator for the piston at one end and a sealable lid engaging cup at the other end, a first inlet port communicating with the interior of the cup, a second inlet port adapted to receive a flexible tube for evacuating flexible containers, said pump having a rigid container evacuation mode and a flexible container evacuation mode, means for selectively blocking the second inlet port in the rigid container evacuation mode, an inlet passage communicating with the pumping chamber and the first and second inlet ports, a one-piece elastomeric suction cup and end cap in the pump, said inlet passage being formed integrally and axially in the one-piece suction cup and end cap, a transverse bore in the vacuum cup and end cap connecting the second inlet port and the inlet passage, a firs check valve between the inlet passage and the first inlet port for maintaining suction in the interior of the cup in the flexible container evacuation mode with the second inlet port unblocked, a second check valve between the inlet passage and the second inlet port that prevents flow through the second inlet port during the discharge stroke of the piston in the flexible container evacuation mode, said inlet passage being a stepped axial bore extending from one end of the pumping chamber, a transverse passage in the pump connecting the second inlet port and the inlet passage, said first check valve including an integral valve seat in the inlet passage between the transverse passage and the pumping chamber and a ball valve engageable with the seat positioned on the side of the seat closest the pumping chamber, said second check valve including an integral seat in the inlet passage between the transverse passage and the first inlet port and a ball valve member engageable with the second check valve seat positioned on the side of the seat closest the pumping chamber.

* * * * *